United States Patent [19]

Burroughs

[11] Patent Number: 4,686,922

[45] Date of Patent: Aug. 18, 1987

[54] SWING WING KEEL

[76] Inventor: Ralph B. Burroughs, 31 Mellon Ave., Troy, N.Y. 12180

[21] Appl. No.: 879,396

[22] Filed: Jun. 27, 1986

[51] Int. Cl.[4] ..... B63B 39/02

[52] U.S. Cl. ..... 114/124; 114/140; 114/143

[58] Field of Search ..... 114/39.1, 121, 126–143

[56] References Cited

U.S. PATENT DOCUMENTS

| | | | |
|---|---|---|---|
| 83,120 | 10/1868 | Stoner et al. . | |
| 106,261 | 4/1870 | Heinrich . | |
| 685,648 | 10/1901 | Schoenhut . | |
| 704,685 | 7/1902 | Jensen . | |
| 713,830 | 11/1902 | York . | |
| 731,227 | 6/1903 | Royse . | |
| 1,061,826 | 5/1913 | Didlake . | |
| 1,082,133 | 12/1913 | Olechnowicz . | |
| 1,102,764 | 7/1914 | Krawczyk . | |
| 1,331,202 | 2/1920 | Kitchen et al. . | |
| 3,324,815 | 6/1967 | Morales . | |
| 3,972,300 | 8/1976 | Adamski . | |
| 4,044,703 | 8/1977 | Kurtz | 114/143 |
| 4,117,797 | 10/1978 | Kelly et al. . | |
| 4,352,335 | 10/1982 | Sugden | 114/143 |
| 4,378,748 | 4/1983 | Kurtz | 114/124 |
| 4,570,563 | 2/1986 | Stenlund | 114/140 |

OTHER PUBLICATIONS

"Hunter 23", Hunter Marine Corporation, pp. 1–2.
"Oday 272", Lear Siegler Marine, pp. 1–4.

*Primary Examiner*—Joseph F. Peters, Jr.
*Assistant Examiner*—Stephen P. Avila
*Attorney, Agent, or Firm*—Heslin & Rothenberg

[57] ABSTRACT

A laterally extending hydrofoil wing is supported in pendulum fashion in a cutout section of a planar keel of a sailing vessel. The pendulum support, in combination with the distribution of mass in the swing wing attempts to maintain the plane of the wing, which is under the surface of a body of water in a position parallel to the surface of a body of water regardless of any rolling or heeling of the vessel. The wing is canted or tilted downwardly into the water in the fore direction of the vessel to plane deeper into the water. When the vessel attempts to roll about its fore and aft axis from its original upright position, the flow of water acting on the canted wing develops a large downward force on the wing and on the keel from which the wing is suspended. The downward force attempts to rotate the keel of the vessel about its fore and aft axis to restore the vessel to its upright position.

8 Claims, 5 Drawing Figures

SWING WING KEEL

BACKGROUND OF THE INVENTION

This invention relates to sailing vessels boats, and the like, and more particularly to a swing wing keel for such vessels and boats.

The efficiency of movement of a vessel in water is significantly affected by any deviation of the vessel from its design balance. If, for example, the main mast of a vessel heels to the starboard, the starboard side of the hull is forced further into the water while the port side tends to lift up from the water. The result is an increase in hull drag in the water and a consequent loss of vessel speed. Other deviations of trajectory such as pitching and yawing produce similar results in speed loss as well as a lack of general stability and control of the vessel.

PRIOR ACT

In order to minimize the above problems, various keel modifications have been proposed such as hinged and tilting keels and centerboards, as well as the use of ballast weights mounted on support structures which are raised and lowered from the hull of the vessel into the water to add a pendulum effect to the vessel, and provide a counterweight or pendulum force to counter any heeling of the vessel. Other proposals include the use of fin-like plates or hydrofoils which are attached to the hull of the vessel and glide through the water under the surface thereof. The plates may be angularly adjusted with respect to the hull so that the water impinging on them tend to force the plates and the hull to which they are attached, in a desired direction. Examples of the foregoing proposals are found in the following U.S. patents;

U.S. Pat. No. 1,061,826—Didlake

U.S. Pat. No. 3,324,815—Morales

U.S. Pat. No. 83,420—Stoner et al.

Didlake discloses in FIG. 5, a pair of plates 17 which extend laterally from a keel below the surface of the water and may be manually angularly adjusted with respect to the keel so that rocking or tossing of the vessel with respect to the vertical plane of the vessel presents a large surface area of the plates normal to the water to minimize the rocking and tossing of a vessel in water.

Morales discloses a sailing vessel with a large central and planar keel. The keel includes a rectangular cutout section with a large planar hydrofoil fin mounted in the cutout section. The fore end of the hydrofoil is fixed to a crank arm and its aft end is pivotally mounted in the keel. Rotation of the crank arm is effective to raise or lower the fore edge of the hydrofoil and also to rotate the hydrofoil along a circular path as the vessel progresses through the water. Planing of the hydrofoil through the water is used to cause some lifting of the boat in the water and consequent reduction in hull drag.

Stoner discloses a hollow keel which houses a chain supported weight or mass which is raised or lowered into the water as a ballast.

In general, prior art proposals do not seem to provide appropriate significance to the fact that certain sailing activities may become quite hurried so that any immediately necessary corrective or additional action, if to be taken, must be accomplished quickly and accurately with minimum crew diversion. It is, therefore, a significant advantage if certain necessary corrective actions may be accomplished by automatic means without disruption of other crew activities.

OBJECTS OF THE INVENTION

It is an object of this invention to provide an improved swing keel for boat hulls.

It is another object of this invention to provide improved swing wing means for a keel of a sailing vessel.

It is yet another object of this invention to provide an improved automatically operating swing wing keel for a sailing vessel.

SUMMARY OF THE INVENTION

The lower part of a keel of a sailing vessel is fitted with a centrally pivoting or pendulum supported, laterally extending wing, the forward edge of which is canted downwardly in the fore direction of the vessel when the wing is submerged in water. In its pendulum position the wing is horizontal or parallel with the surface of the water on which the vessel sails. The wing acts as a hydrofoil or fin and planes through the water as the vessel sails along. However, as the vessel rolls or tilts, the pivoting wing, having a significant mass, acts as a pendulum and attempts to take up its original position with the wing extending parallel to the surface of the water. Because the leading edge of the wing is canted downwardly, the wing attempts to penetrate more deeply into the water and the flowing water then acts on a larger surface area of the wing forcing the wing further downwardly. This downward force acts on the pivot of the wing and the keel to attempt to rotate the keel to the original vertical position. The swing wing thus acts to minimize deviations from the desired trajectory of the hull in the water caused by pitching, yawing, and heeling.

The above and other objects, features and advantages of this invention will be better understood when taken in connection with the accompanying drawings and specification.

DESCRIPTION OF THE PREFERRED EMBODIMENT

Figure 1:
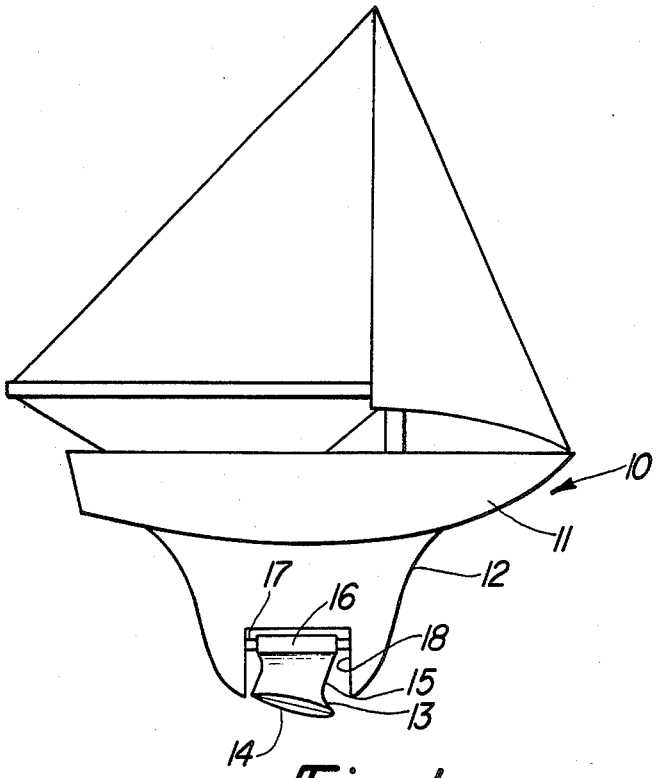
FIG. 1 is a small sketch of a sailing vessel to which this invention is particularly applicable.

Referring now to FIG. 1, there is shown a sailing vessel 10, having the usual longitudinally extending hull 11 and keel 12 and adapted to float on a body of water. A swing wing 13 is associated with keel 12 as illustrated in larger detail in FIG. 2.

Figure 2:
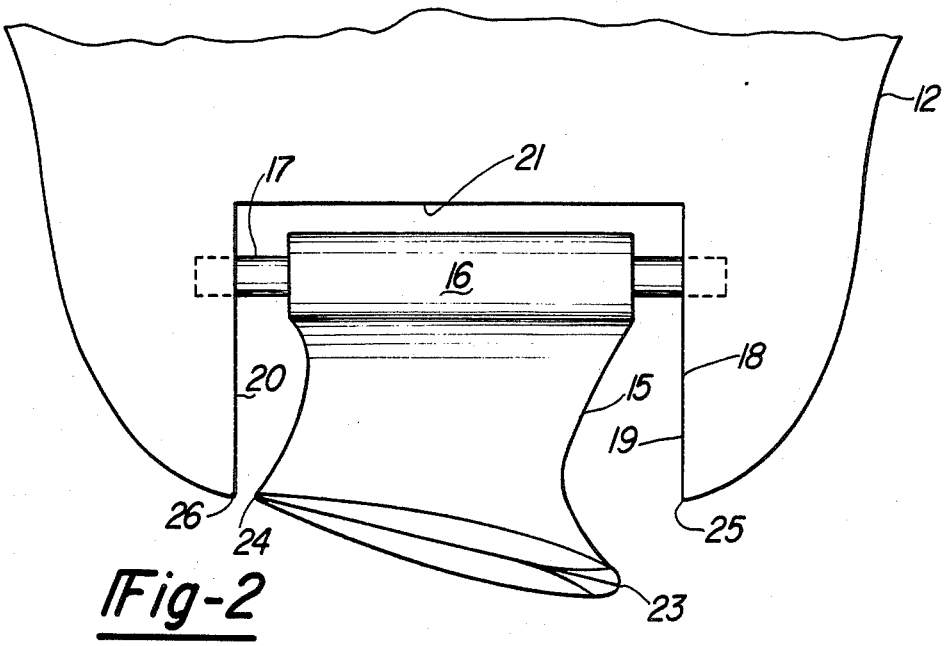
FIG. 2 is an enlarged sketch of the lowermost part of the vessel of FIG. 1.

Referring now to FIG. 2, swing wing 13 comprises a lateral planar wing section 14 and an upstanding or vertical web support section 15 thereon. One end of upstanding support section 15 is smoothly contoured to wing section 14 while at the other end web section 15 is formed into a central cylindrical section or journal 16 which is a bearing member for the support shaft 17. Keel 12 is provided with a large rectangular cutout section 18 and support shaft 17 is fixed in the upper part of cutout section 18 to span the cutout section 18 in the fore and aft direction of vessel 10. Cutout section 18 is defined by a pair of spaced, vertical, keel walls 19 and 20 and a transverse wall 21 which is spaced from the lowermost edge of keel 12 toward the hull 11. Swing wing 13 may be adapted to pivot about shaft 17, or it may be fixed to shaft 17 and shaft 17 may be adapted for limited rotation in keel walls 19 and 20. The swing wing of this invention is a large member of significant mass whose weight and swing or pendulum action contributes to the torque action tending to restore the vertical position of a tilting or rolling vessel. Accordingly, swing wing 13 may be an iron casting or a cast iron core covered with lead and may weigh (in air) as much as 1000 pounds or more.

The weight alone of the swing wing of this invention serves to lower the center of gravity of the vessel and inhibit heeling of the vessel. Also, the application of the swing wing of this invention reduces the size as well as the depth of a keel as compared to a usual keel without a swing wing.

Figure 3:
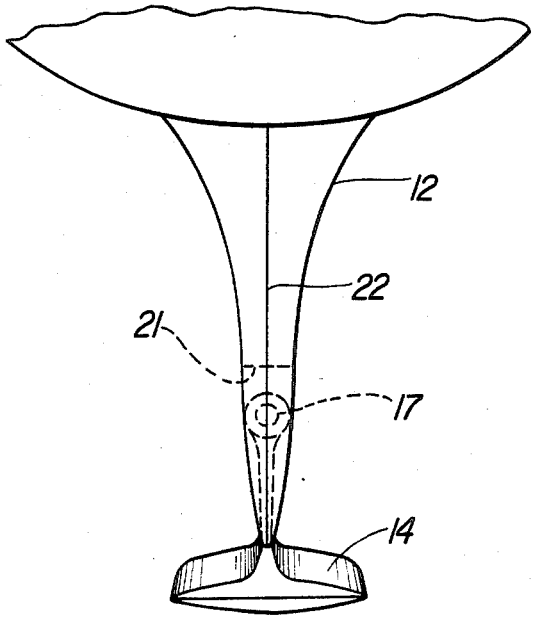
FIG. 3 is a frontal elevational view of the swing wing of this invention applied to the keel of the sailing vessel of FIG. 1.
Figure 4:
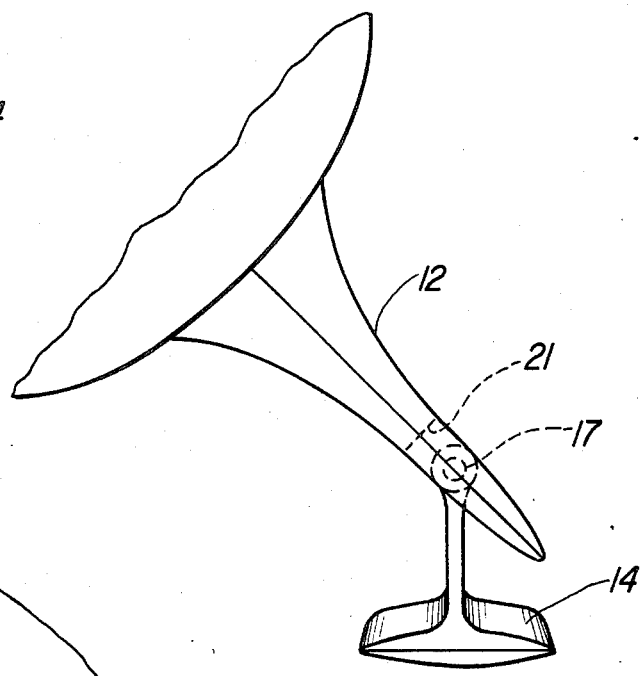
FIG. 4 is a sketch illustrating the pendulum action of the swing wing keel of this invention when the vessel hull tilts to one side.
Figure 5:
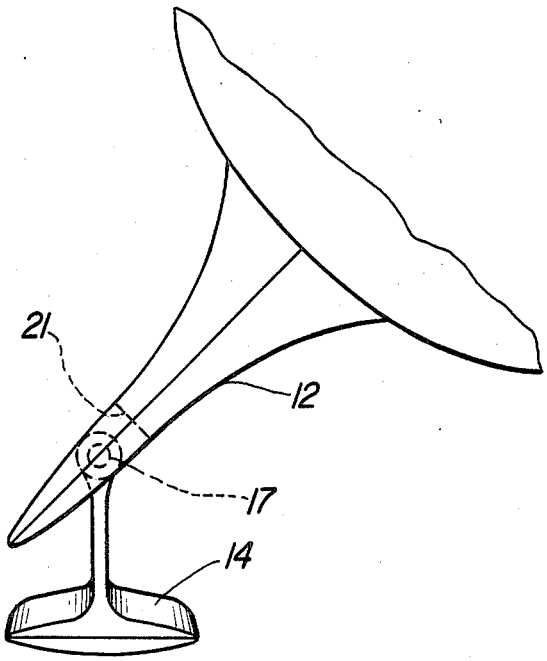
FIG. 5 is a sketch illustrating the pendulum action of the swing wing keel when the vessel tilts to the other side.

The swing wing keel of this invention is also operative to automatically apply a restoring force to a vessel which is heeling to a significant degree. The "normal" or "at rest" position of swing wing 13 is that as illustrated in FIGS. 1, 2, and 3. The swing wing of this invention may be described as including a wing section and an upstanding web support section. The wing section 14 takes the general shape of an elongated narrow rectangular planar hydrofoil. The web section 15 is also of a generally rectangular shape which is joined transversely to the hydrofoil intermediate its ends. The combination of the hydrofoil and the joined web section presents an inverted T configuration with the web section being the tang of the T and the hydrofoil being the transverse member of the T.

In order to provide the downward slope or cant of the wing section 14 as illustrated in FIG. 2, the line of the transverse joint between wing section 14 and web section 15 is disposed at an angle to the plane of the wing section 14. This angular disposition is the angle or slope of wing section 14 relative to web section 15.

As illustrated in FIG. 3, keel 12 is joined to hull 11 along the longitudinal axis of the hull 11 in the fore and aft direction. The web section 15 of swing wing 13 takes up a position in the plane of the keel 11 and parallel to the vertical certerline 22 of vessel 10. The wing section 14 extends laterally from and perpendicular to the plane of the keel providing in one sense, a pair of oppositely and laterally extending wings or hydrofoils. The pendulum effect of swing wing 13 tends to retain the web section 15 in the vertical position as shown in FIG. 3 and the wing section 14 extends in a horizontal or lateral position, both positions being with respect to the vessel 10 at rest on a body of water. In this connection, the term "downwardly" as utilized herein is intended to mean deeper into the water and further from the surface of the water at rest. In its "at rest" position wing section 14 is submerged in the water with its longitudinal axis generally parallel to the surface of the water. Keel 12 is described as projecting vertically from the hull downwardly into the water, and, on a body of water at rest the plane of the keel is perpendicular to the plane of the surface of the water at rest. Swing wing 13 takes up the position as described because of its significant weight and its pendulum or pivot mounting. The weight of swing wing 13 is sufficient to provide some ballasting action for vessel 10, and, because of its weight, it lowers the center of gravity of vessel 10.

Also, as illustrated in FIG. 2, the wing section 14 takes the shape of a fin or hydrofoil with smoothly tapering leading and trailing edges 23 and 24, respectively. Furthermore, the wing section 14 is canted in the fore and aft directions so that its leading edge 23 is a greater distance from the bottom edge 25 of keel 11 as compared to the distance of trailing edge 24 from point 26 of keel 11. Points 25 and 26 are assumed to be equidistant from the longitudinal axis of hull 11. The planar wing section 14 is a hydrofoil which planes smoothly through the water as the sailboat sails along. Because of the downward cant of wing 14 in the fore direction, it tends to submerge or plane deeper into the water and the force of the water then acts on a larger projected surface area of wing section 14 rather than only on the leading edge. By this means a large downward force is developed and exerted on the keel 12 and sailing vessel 10. This downward force minimizes and counteracts any rolling motion of vessel 10. For example, should vessel 10 proceed into a turn and heel over, the swing wing 13, because of its weight and pivot or pendulum mounting, will attempt to assume a vertical position as illustrated in FIG. 3, and because of its downward cant, its leading edge attempts to plane deeper into the water. This planing exposes a larger surface area of the wing 14 to project against the water causing a considerable counter rotating force or torque acting to rotate the hull about its longitudinal axis. This torque or counter rotating force or torque acting to rotate the hull about its longitudinal axis. This torque or counter rotating force acts on the keel as a crank arm tending to rotate keel 12 and hull 11 about the longitudinal axis of hull 11 in a direction opposite to the heeling forces on the vessel attempting to rotate the vessel about its longitudinal axis. At any time the sailing vessel attempts to rotate about its longitudinal axis, the swing wing of this invention pivots so that the swing section 14 planes into the water to present a larger surface area to the water and generate a large force against the swing wing 13 and its shaft support 16 to provide a countervailing force tending to keep the vessel in an upright position and on an "even keel."

It is an advantage of the swing of the present invention that in moments of extreme activity in sailing duties there is no actuating mechanism requiring immediate manual effort by a crew member with resultant diversion from other activities. With the swing wing of this invention, the force of gravity automatically brings the swing wing into the correct position for immediate operation.

An exemplary structure for a swing wing with a positive response to gravity as well as having a significant ballast action comprises a unitary core structure covered with a dissimilar material. One example, where weight is desirable, comprises a cast iron core coated with a thick coating of lead. Where weight is not a primary consideration, the lead may be replaced with a chemical composition such as polymethylene, polypropylene and other such resins, and the core structure may comprise various metal alloys. The swing wing of this invention may comprise only a short length of a keel, as illustrated in FIGS. 1 and 2, or, the swing wing may progressively occupy greater lengths of the keel to the extent that the entire keel of a sailing vessel would be a swing wing.

While a preferred embodiment of this invention has been illustrated and described, it will be obvious to those skilled in the art that various changes and modifications may be made therein without departing from the scope of the invention as defined in the appended claims.

What is claimed is:

1. In a sailing vessel having a hull adapted to float on a body of water and a central keel member attached to the hull thereof and projecting vertically downwardly therefrom into the water on which said hull rests, the improvement comprising, a swing wing for said keel, (a) said swing wing comprising in combination a generally rectangular hydrofoil planar wing section having smoothly tapering leading and trailing edges, (b) an upstanding generally rectangular web support section joined to said wing section at the longitudinal center thereof and transversely thereto, said web section being perpendicular to said wing section, said web section and said wing section defining a generally inverted T configuration, (c) and mounting means on the upstanding end of said web section to suspend said swing wing so that the plane of said keel member is perpendicular to said wing section, (d) said mounting means being adapted to suspend said swing wing in a pendulum arrangement during heeling motion of the vessel during which the said wing section attempts to take up and maintain a position parallel to the surface of the water on which said hull rests.

2. A boat having a longitudinally extending hull adapted to float on a body of water, (a) a planar keel member projecting downwardly from said hull with the plane of said keel being perpendicular to the surface of said body of water, (b) said keel member having a large rectangular cutout section therein, (c) said cutout section being defined by a pair of spaced fore and aft vertical walls, and a transverse horizontal wall interconnecting said vertical walls to define the rectangular cutout section, (d) and a support shaft parallel to but spaced from said horizontal wall and having one end supported in said fore end wall and the other end supported in said aft end wall, (e) said support shaft spanning the rectangular cutout section, and (f) a swing wing pivotally mounted on said support shaft, (g) said swing wing comprising a generally narrow rectangular hydrofoil wing section, (h) a generally rectangular web section joined at one end to said wing section in a transverse position at the mid point of the length of said wing section so that the web section and wing section provide the appearance of an inverted T section, (i) the other end of said web section being formed to provide a journal support for said shaft, (j) said swing wing being free to pivot and swing about said support shaft, (k) the mass of said swing wing being appropriately distributed so that the web section is suspended vertically from said support shaft in said cutout section and said wing section maintains a horizontal relationship perpendicular to said web section to project laterally from each side of said keel to plane through the water as the vessel sails along, (l) said wing section and said web section being formed so that the wing section is canted downwardly with the leading edge thereof being downwardly below the trailing edge with respect to a horizontal line defined by said support shaft spanning said cutout, (m) said swing wing being free to swing as a pendulum from said support shaft in the port and starboard directions.

3. In a sailing vessel having an elongated hull and a longitudinally extending keel attached to said hull, said keel being a large planar member attached to said hull along the centerline thereof in the fore and aft directions and projecting away from said hull into a body of water, and said planar keel having a large rectangular cutout section therein below the surface of said water, and said cutout section being defined by a pair of spaced fore and aft keel walls as two vertical sides of said rectangular cutout section and a transverse wall therebetween as the third side of said rectangular section, the fourth side of said cutout section being open to the water, the improvement comprising in combination (a) a swing wing pivotally mounted in said cutout section, (b) said swing wing comprising a narrow rectangular hydrofoil wing, (c) and a rectangular upstanding web section having one side edge attached transversely to said rectangular wing section at a mid point thereof to provide a general configuration of an inverted T section, (d) the opposite unattached side edge of said web section having a journal formed thereon extending along the said unattached side edge, (e) and a support shaft having one end affixed to the said fore keel wall and the other end affixed to said aft keel wall, (f) the said support shaft being parallel with and spaced from said transverse keel wall to span said cutout section in the fore and aft directions, (g) said support shaft passing through said journal on said web section to support said swing wing in said cutout section with the said web section taking up a vertical position to be parallel with the plane of said keel and in alignment with said spaced fore and aft keel walls, (h) the wing section of said swing wing taking up a horizontal position perpendicularly to the plane of said keel and extending laterally away from said keel in both the port and starboard directions, (i) said swing wing being free to swing as a pendulum in the port and starboard directions by means of its support shaft and journal mounting, (j) the said wing section and web section being so formed that when suspended from the support shaft the leading edge of said wing section is displaced downwardly from said hull a distance greater than the trailing edge, (k) the mass distribution of said swing wing being such that the pendulum action at rest keeps the web section parallel to the plane of the keel and the wing section extending in the port and starboard directions outwardly from and perpendicular to the plane of the keel so that as the vessel sails along on the surface of said body of water with the plane of the keel perpendicular to the plane of the surface of the body of water, the canted leading edge of the wing section attempts to penetrate further into the water exposing a large upper surface area thereof to the flow of water therealong and generating a large force acting on the wing section to force it in a direction deeper into the water.

4. A swing wing keel member for the hull of boats and sailing vessels comprising in combination (a) an elongated narrow rectangular hydrofoil wing section, (b) a generally rectangular upstanding web section joined transversely to said hydrofoil at an intermediate position between the ends thereof, (c) said web section and said hydrofoil displaying an inverted T configuration with the hydrofoil representing the cross of the T and the web section the tang of the inverted T, the web section being joined to said wing section along an edge of said web section which is angularly disposed relative to horizontal.

5. The invention as recited in claim 4 wherein said swing wing comprises a single piece unitary core structure coextensively covered with a thick coating of a material dissimilar to the material of the said core structure.

6. The invention as recited in claim 5 wherein said coating comprises lead and said unitary core structure comprises cast iron.

7. The invention is recited in claim 4 wherein a leading edge of the wing section is canted downwardly with respect to a trailing edge of said wing section.

8. The invention is recited in claim 7 further comprising pivot support means secured along the upper edge of said web section for permitting said swing wing keel member to freely pivot in port and starboard directions.

* * * * *